US008516867B2

(12) United States Patent
Hosho et al.

(10) Patent No.: US 8,516,867 B2
(45) Date of Patent: Aug. 27, 2013

(54) MANUFACTURING APPARATUS OF HOT-ROLLED STEEL SHEET AND MANUFACTURING METHOD OF STEEL SHEET

(75) Inventors: Tomofumi Hosho, Kashima (JP); Yoichi Haraguchi, Sakura (JP); Kazuaki Kobayashi, Kashima (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/300,738

(22) Filed: Nov. 21, 2011

(65) Prior Publication Data

US 2012/0079863 A1 Apr. 5, 2012

Related U.S. Application Data

(63) Continuation of application No. PCT/JP2010/060564, filed on Jun. 22, 2010.

(30) Foreign Application Priority Data

Jul. 15, 2009 (JP) ..... 2009-167068

(51) Int. Cl.
*B21B 27/06* (2006.01)

(52) U.S. Cl.
USPC ..... 72/201; 72/8.5; 72/236; 72/39; 148/661

(58) Field of Classification Search
USPC ..... 72/53, 201, 342.2, 342.5, 342.6
See application file for complete search history.

(56) References Cited

U.S. PATENT DOCUMENTS

| | | | | |
|---|---|---|---|---|
| 5,435,945 | A * | 7/1995 | De Paoli et al. | 264/7 |
| 6,835,253 | B1 * | 12/2004 | Kawalla et al. | 148/547 |
| 7,523,631 | B2 * | 4/2009 | Fujibayashi et al. | 72/201 |
| 7,665,339 | B2 * | 2/2010 | Valence et al. | 72/238 |
| 2009/0019907 | A1 | 1/2009 | Ueoka et al. | |

FOREIGN PATENT DOCUMENTS

| | | |
|---|---|---|
| JP | 2005-206917 | 8/2005 |
| JP | 4029871 | 10/2007 |
| WO | 2007/099676 | 9/2007 |

* cited by examiner

*Primary Examiner* — Dana Ross
*Assistant Examiner* — Homer Boyer
(74) *Attorney, Agent, or Firm* — Clark & Brody

(57) ABSTRACT

A manufacturing apparatus comprises a final stand, with standing side members, and a cooling apparatus. The cooling apparatus comprises rows of upper surface cooling nozzles, rows of lower surface cooling nozzles, and an upper surface guide on the upper surface side of the steel sheet. An end portion of the cooling apparatus on a side of the final stand is arranged between the standing side members of the housing. When defining a width of a uniformly cooled region, an average gap distance ($W_{sw}$) between the end portion of the width of the uniformly cooled region and the standing side member of the housing; a gravity acceleration rate, an average water volume density of the width of the uniformly cooled region, and a value determined by $W_{sw}$ and an average distance h between the upper surface guide and the upper surface of the steel sheet, a specific relation is satisfied.

5 Claims, 12 Drawing Sheets

MANUFACTURING APPARATUS OF HOT-ROLLED STEEL SHEET AND MANUFACTURING METHOD OF STEEL SHEET

TECHNICAL FIELD

The present invention relates to a manufacturing apparatus of a hot-rolled steel sheet and a manufacturing method of a steel sheet. More particularly, it relates to a manufacturing apparatus of a hot-rolled steel sheet and a manufacturing method of a steel sheet using the manufacturing apparatus which are excellent in discharging water as a cooling medium.

BACKGROUND ART

A steel material used for automobiles, structural materials, and the like is required to be excellent in such mechanical properties as strength, workability, and toughness. In order to improve these mechanical properties comprehensively, it is effective to make a steel material with a fine-grained structure; to this end, a number of manufacturing methods to obtain a steel material with a fine-grained structure have been sought. Further, by making the fine-grained structure, it is possible to manufacture a high strength hot-rolled steel sheet having excellent mechanical properties even if the amount of alloying elements added is reduced.

As a method for making a steel sheet with a fine-grained structure, it is known to carry out a high rolling reduction especially in the subsequent stage of hot finish rolling, deforming austenite grains greatly and increasing a dislocation density; and thereby to obtain fine-grained ferrite after cooling. Further, in view of facilitating the ferrite transformation by inhibiting recrystallization and recovery of the austenite, it is effective to cool a steel sheet to 600° C. to 700° C. as quickly as possible after rolling. In other words, subsequent to hot finish rolling, it is effective to rapidly cool a steel sheet after the rolling by arranging a cooling apparatus capable of cooling more quickly than ever before. In rapidly cooling a steel sheet after rolling in this way, it is recommended to have a large volume of cooling water sprayed over the steel sheet per unit area, and to have a high flow density in order to enhance a cooling capability.

However, if the volume of cooling water and the flow density are increased in this way, the water accumulated (i.e. retained water) on an upper surface of a steel sheet increases due to a relation between water supply and water discharge. On the other hand, on a lower surface side of a steel sheet, the retained water between a lower surface guide and the steel sheet increases. This retained water is the water which has remained after being used for cooling the steel sheet. Thus, it is desired to discharge the water as quickly as possible and to provide the steel sheet with water supplied from a cooling nozzle, thereby ensuring a cooling capability. Further, since the retained water is a layer of water, if the layer is thick, the thickness sometimes hinders water from the cooling nozzle from reaching the steel sheet effectively. Furthermore, the retained water flows from a middle portion of the steel sheet toward an end portion of the steel sheet; and the flow rate increases as the water approaches the end portion of the steel sheet. So, if the amount of retained water increases, cooling nonuniformity in a width direction of the steel sheet occurs to a large degree. In addition, if the amount of the retained water increases excessively, an end portion of the cooling nozzle sinks in the retained water on the upper surface guide.

As described above, it is effective to rapidly cool a steel sheet as soon as possible after hot finish rolling; thus cooling immediately after a work roll in a final stand of a row of hot finish rolling mills is preferable. In other words, a steel sheet is preferably cooled by spraying cooling water over the steel sheet which is inside the housing of the final stand in the row of hot finish rolling mills. This way of cooling is disclosed in Patent Document 1.

CITATION LIST

Patent Literature

Patent Document 1: Japanese Patent (JP-B) No. 4029871

SUMMARY OF INVENTION

Problems to be Solved by the Invention

Much of the cooling water sprayed on an upper surface side of a steel sheet moves in a width direction of the steel sheet, and drops downwardly to be discharged. However, inside the housing of the final stand in the row of hot finish rolling mills, standing side members of the housing are disposed on both sides of a transporting pass line of the steel sheet. Therefore, in a case when cooling water is sprayed inside the housing of the final stand, the standing side members of the housing become walls to prevent discharge of the cooling water. Further, the discharged water strikes against the side wall, and a part of the cooling water (i.e. the discharged water) which has moved upward is retained on an upper surface guide, thereby causing an end portion of a cooling nozzle to sink in the retained water. Patent Document 1 discloses improvement of a water discharging performance of an upper surface guide. However, when a larger volume of cooling water is used in order to improve a cooling performance, it is also important to improve water discharge from a side of the steel sheet.

Accordingly, in view of the above problems, the present invention provides, in a production line of a hot-rolled steel sheet, a manufacturing apparatus of a hot-rolled steel sheet, and a manufacturing method of a steel sheet, which are excellent in discharging water.

Means for Solving the Problems

The present invention will be described below.

A first aspect of the present invention is a manufacturing apparatus of a hot-rolled steel sheet comprising: a row of hot finish rolling mills; and a cooling apparatus which is disposed on a lower process side of a final stand in the row of hot finish rolling mills in a manner capable of cooling a steel sheet being transported on transporting rolls, wherein the final stand comprises a housing which holds a work roll; the housing comprises a pair of standing side members; the cooling apparatus comprises a plurality of rows of upper surface cooling nozzles which are provided with cooling nozzles capable of spraying cooling water over an upper surface of the transported steel sheet, and which are disposed along a transporting direction of the transported steel sheet; the cooling apparatus comprises a plurality of rows of lower surface cooling nozzles which are provided with cooling nozzles capable of spraying cooling water over a lower surface of the transported steel sheet, and which are disposed along the transporting direction of the transported steel sheet; the cooling apparatus comprises an upper surface guide which is disposed on the upper surface side of the transported steel sheet; an end portion of the cooling apparatus on a side which is the closest to the final stand is disposed between the pair of the standing side members of the housing in the final stand; and when defining a width of a uniformly cooled region as W [m]; defining an average gap distance between the end portion of the width of the uniformly cooled region and the standing side member of the housing as $W_{sw}$ [m]; defining a gravity acceleration rate as g [m/s$^2$]; defining an average water volume density in the width of the uniformly cooled region as $Q_q$ [m$^3$/m$_2$·s)]; defining a value determined by $W_{sw}$ and an average distance h [m] between the upper surface guide and the upper surface of the steel sheet as C; and satisfying a relation, $Q_q$>0.08, a relation $$\left[1.7+\left(1-\frac{1}{C}\right)^2\right]+\frac{\left(Q_q\cdot\frac{W}{W_{SW}}\right)^2}{8g}<1$$

is satisfied.

Herein, the "width of a region uniformly cooled" by the cooling nozzle, refers to a size of a region in the width direction of the steel sheet, in which region the transported steel sheet can be uniformly cooled, based on the characteristics of the cooling nozzles arranged. Specifically, the width of the uniformly cooled region often corresponds to a width of a maximum size of the steel sheet which can be manufactured by the manufacturing apparatus of a steel sheet.

Further, the "cooling water" refers to cooling water as a cooling medium, and is not required to be so-called purified water. The cooling water may contain incidental impurities, like industrial water and the like.

A second aspect of the present invention is the manufacturing apparatus of a hot-rolled steel sheet according to the first aspect, wherein the cooling nozzle provided to the row of cooling nozzles is a flat spray nozzle.

A third aspect of the present invention is a manufacturing method of a hot-rolled steel sheet, wherein a steel sheet is manufactured by passing the steel sheet into the manufacturing apparatus of a hot-rolled steel sheet according to the first or second aspect.

A fourth aspect of the present invention is a manufacturing method of a hot-rolled steel sheet, wherein a steel sheet is manufactured by passing the steel sheet into the manufacturing apparatus of a hot-rolled steel sheet according to the first or second aspect; and the manufacturing method of a hot-rolled steel sheet comprises: a step of finish rolling with the largest rolling reduction of the final stand in the row of hot finish rolling mills; and a step of cooling by using a cooling apparatus.

A fifth aspect of the present invention is a manufacturing method of a hot-rolled steel sheet, wherein a steel sheet is manufactured by passing the steel sheet into the manufacturing apparatus of a hot-rolled steel sheet according to the first or second aspect; the manufacturing apparatus comprises a pinch roll on a lower process side of a cooling apparatus; and the cooling apparatus starts cooling after a top portion of the passing steel sheet reaches the pinch roll.

Effects of the Invention

With the present invention, it is possible to provide, in a production line of the hot-rolled steel sheet, a manufacturing apparatus of a hot-rolled steel sheet and a manufacturing method of a hot-rolled steel sheet which are excellent in discharging water. And by these, it is possible to increase a volume of cooling water and to further facilitate rapid cooling after rolling, thereby enabling manufacturing of a steel sheet with an excellent mechanical performance.

DESCRIPTION OF THE SYMBOLS

Figure 1:
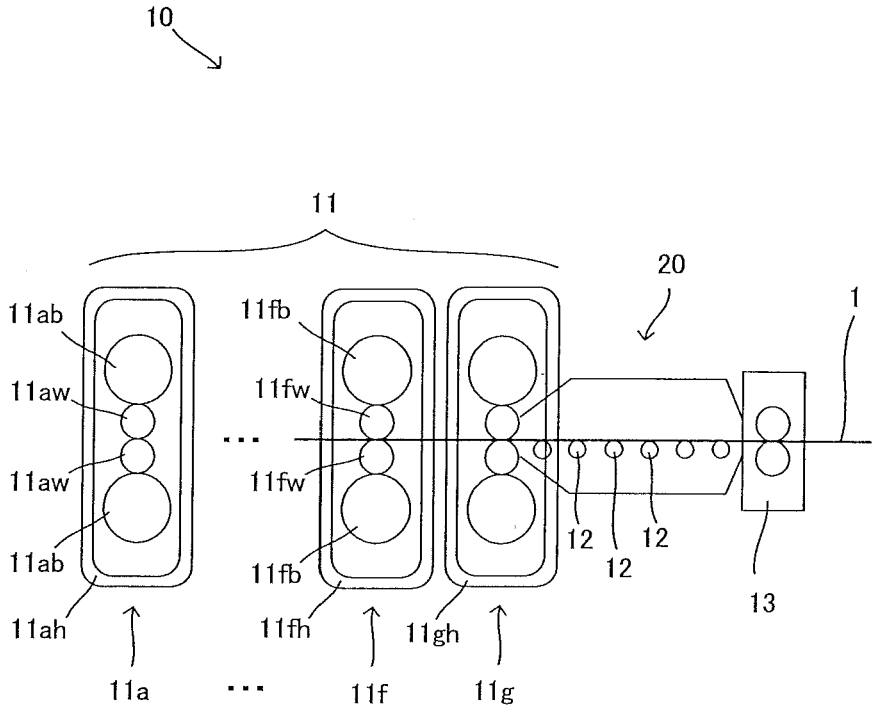
FIG. 1 is a schematic view showing a part of a manufacturing apparatus of a hot-rolled steel sheet according to one embodiment.

1 steel sheet
10 manufacturing apparatus
11 row of rolling mills
11*g* final stand
11*gh* housing
11*gr* standing side member (of housing)
12 transporting roll
13 pinch roll
20 cooling apparatus
21 upper surface water supplying device
21*a* cooling header
21*b* conduit
21*c* cooling nozzle
22 lower surface water supplying device
22*a* cooling header
22*b* conduit
22*c* cooling nozzle
30, 130, 130', 230, 230' upper surface guide
40 lower surface guide

MODES FOR CARRYING OUT THE INVENTION

The functions and benefits of the present invention described above will be apparent from the following modes for carrying out the invention. The present invention will be described based on the embodiments shown in the accompanying drawings. However, the invention is not limited to these embodiments.

FIG. 1 is a schematic view of a part of manufacturing apparatus 10 of a hot-rolled steel sheet according to one embodiment. In FIG. 1, a steel sheet 1 is transported from a left on the sheet of paper (upper process side, upstream side) to a right (lower process side, downstream side), a direction from a top to a bottom on the sheet of paper being a vertical direction. A direction from the upper process side (upstream side) to the lower process side (the downstream side) is sometimes referred to as a sheet passing direction. Further, a direction of a width of the passing steel sheet, which is orthogonal to the sheet passing direction is sometimes referred to as a width direction of a steel sheet. Reference symbols may be omitted in the below descriptions of the drawings for the purpose of easy viewing.

As shown in FIG. 1, the manufacturing apparatus 10 of a hot-rolled steel sheet comprises: a row 11 of hot finish rolling mills; a cooling apparatus 20; transporting rolls 12, 12, . . . ; and a pinch roll 13. Further, a heating furnace, a row of rough rolling mills, and the like, the figures and descriptions of which are omitted, are arranged on the upper process side of the row 11 of hot finish rolling mills; and set better conditions for a steel sheet to go through the row 11 of hot finish rolling mills. On the other hand, another cooling apparatus or various kinds of equipment such as a coiler to ship the steel sheet as a steel sheet coil, are arranged on the lower process side of the pinch roll 13.

A hot-rolled steel sheet is generally manufactured in the following way. A rough bar which has been taken from a heating furnace and has been rolled by a rough rolling mill to have a predetermined thickness is rolled continuously by the row 11 of hot finish rolling mills to have a predetermined thickness, while controlling a temperature. After that, the steel sheet is rapidly cooled in the cooling apparatus 20. Here, the cooling apparatus 20 is disposed from inside the housing 11*gh* which supports rolls, in the final stand 11*g* of the row 11 of hot finish rolling mills. More specifically, the cooling apparatus is disposed in a manner as closely as possible, to the rolls 11*gw*, 11*gw* in the final stand 11*g* (see FIG. 2). Then, the steel sheet passes through the pinch roll 13 to be cooled by another cooling apparatus to a predetermined coiling temperature, and is coiled by a coiler.

Figure 2A:
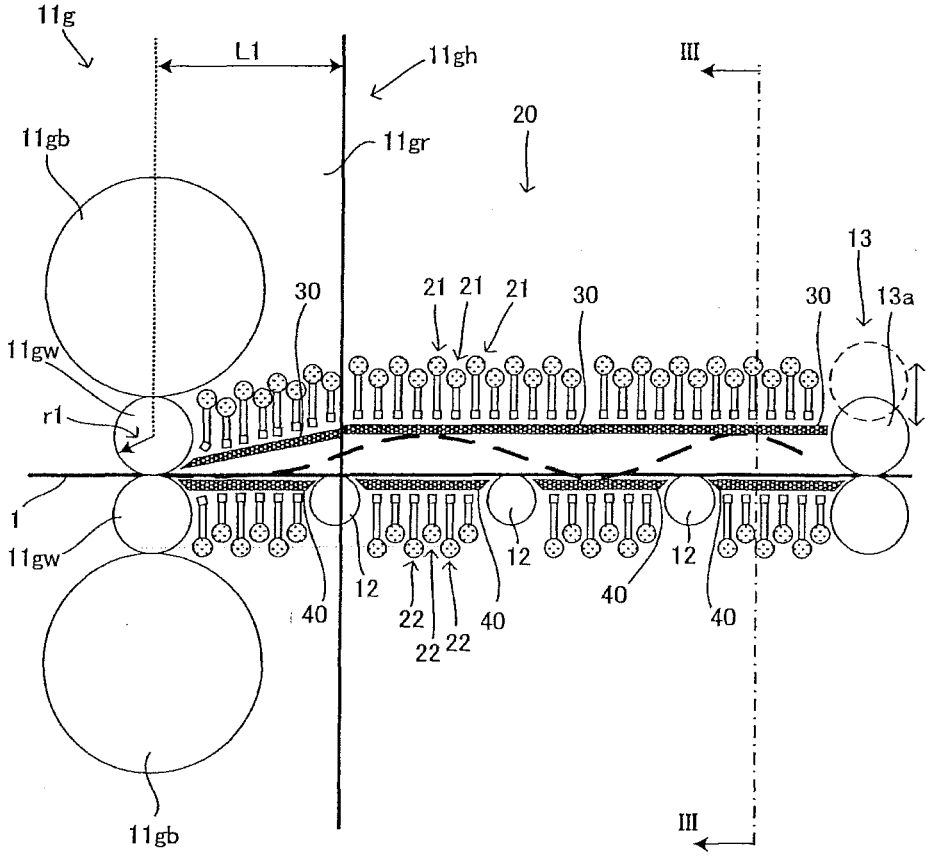
FIG. 2 is an enlarged view focusing on an area in FIG. 1, in which a cooling apparatus is disposed.
Figure 2B:
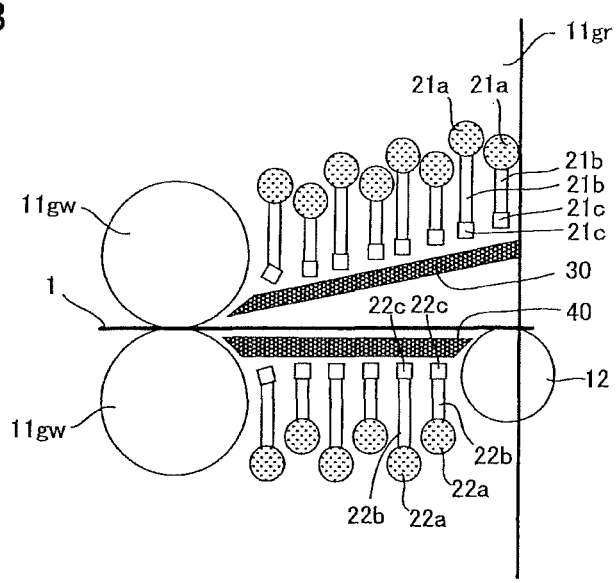
Figure 3:
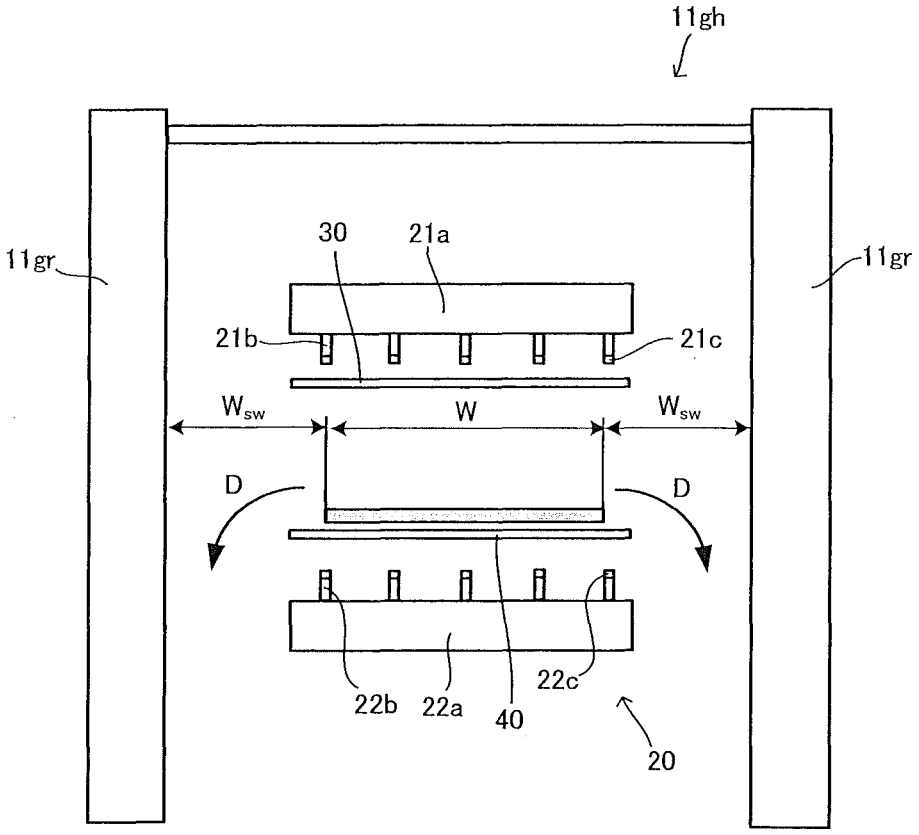
FIG. 3 is a cross-sectional view along arrows in FIG. 2A.

Hereinafter, the manufacturing apparatus 10 of a steel sheet (, which may simply be referred to as a "manufacturing apparatus 10") will be described in detail. FIG. 2 is an enlarged view of an area in FIG. 1, in which the cooling apparatus 20 is provided. FIG. 2A is an enlarged view showing the cooling apparatus 20 in its entirety, whereas FIG. 2B is a view further focusing on the vicinity of the final stand 11*g*. FIG. 3 is a cross-sectional view along arrows III-III in FIG. 2A. Thus, in FIG. 3, a direction from a top to a bottom on the sheet of paper is a vertical direction of the manufacturing apparatus 10; a direction from a left to a right on the sheet of paper is the width direction of the steel sheet; and a direction from a back part to a front part on the sheet of paper is the sheet passing direction.

As seen from FIG. 1, the row 11 of hot finish rolling mills in the embodiment comprises seven rolling mills (11*a*, 11*b*, 11*c*, . . . , 11*g*) aligned along the sheet passing direction. Each of the rolling mills 11*a*, 11*b*, . . . , 11*g* forms each stand, and rolling conditions such as a rolling reduction are set in each of the rolling mills to enable the steel sheet to meet conditions for thickness, mechanical properties, surface quality, and the like which are required as a final product. Here, a rolling reduction in each stand is set so that a manufactured steel sheet can meet a performance that the steel sheet is required to have. However, in view of carrying out a high rolling reduction to cause deformation of austenite grains and to increase a dislocation density; and thereby obtaining fine ferrite grains after cooling, a large rolling reduction is preferable in the final stand 11*g*.

A rolling mill in each stand comprises: a pair of work rolls (11*aw*, 11*aw*, . . . , 11*fw*, 11*fw*, 11*gw*, 11*gw*) which actually gets the steel sheet 1 caught in between to reduce a thickness of the steel sheet; and a pair of backup rolls (11*ab*, 11*ab*, . . . , 11*fb*, 11*fb*, 11*gb*, 11*gb*) which are disposed in a manner contacting the outer peripheries of the backup rolls and the work rolls with each other. Further, a rotary shaft of the work roll and the backup roll is arranged between the opposing standing side members (e.g. the standing side members 11*gr*, 11*gr* shown in FIG. 3 in a case of the final stand) of the housing (11*ah*, . . . , 11*fh*, 11*gh*), which are arranged in a manner to include the work roll and the backup roll therein. In other words, as seen from FIG. 3, the standing side members of the housing are arranged to stand in a manner sandwiching a passing line of the steel sheet (pass line).

Herein, a distance between the work roll 11*gw* and the end surface of the standing side member 11*gr*, 11*gr* of the housing on the lower process side, shown as L1 in FIG. 2A, is larger than the radius r1 of the work roll 11*gw*. Therefore, as described below, a part of the cooling apparatus 20 can be disposed in an area corresponding to L1−r1. In other words, it is possible to dispose the part of the cooling apparatus 20 in such a manner as being incorporated into the housing 11*gh*.

Further, as shown in FIG. 3, gaps shown as $W_{sw}$, $W_{sw}$ is formed between the end portions of the width W of the region uniformly cooled by the cooling apparatus 20 (see FIG. 5) and the standing side members 11*gr*, 11*gr* of the housing. A size of the gap $W_{sw}$ will be described later together with the descriptions of the cooling apparatus 20.

Next, the cooling apparatus 20 is described. The cooling apparatus 20 comprises: upper surface water supplying devices 21, 21, . . . ; lower surface water supplying devices 22, 22, . . . ; upper surface guides 30, 30, . . . ; and lower surface guides 40, 40, . . . .

The upper surface water supplying devices 21, 21, are devices to supply cooling water to an upper surface side of the steel sheet 1. The upper surface water supplying devices 21, 21, . . . comprise: cooling headers 21*a*, 21*a*, . . . ; conduits 21*b*, 21*b*, . . . , provided to each of the cooling headers 21*a*, 21*a*, . . . , in a form of a plurality of rows; and cooling nozzles 21*c*, 21*c*, . . . attached to an end portion of the conduits 21*b*, 21*b*, . . . .

As seen from FIGS. 2 and 3, in the embodiment, the cooling header 21*a* is a pipe extending in the width direction of the steel sheet; and these cooling headers 21*a*, 21*a* are aligned in the sheet passing direction.

The conduit 21*b* is a thin pipe diverging from each cooling header 21*a* in a plural form, and an opening end of the conduit is directed toward the upper surface side of the steel sheet. A plurality of the conduits 21*b*, 21*b*, . . . are arranged in a comb-like manner along a direction of a tube length of the cooling header 21*a*, namely, in the width direction of the steel sheet.

Figure 4:
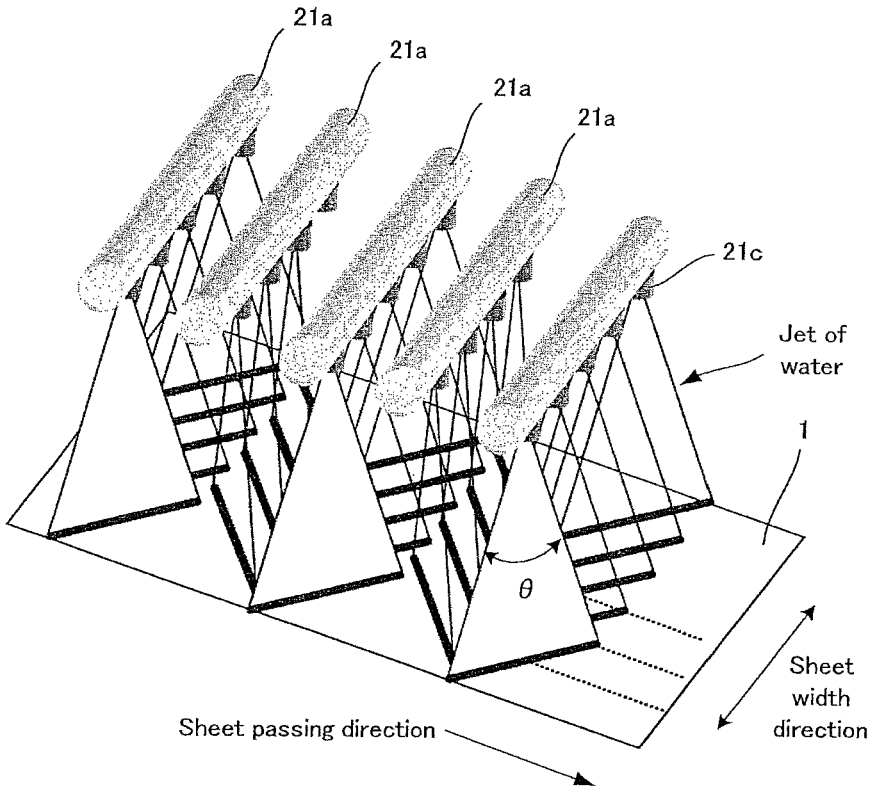
FIG. 4 is a perspective view illustrating a cooling nozzle.
Figure 5:
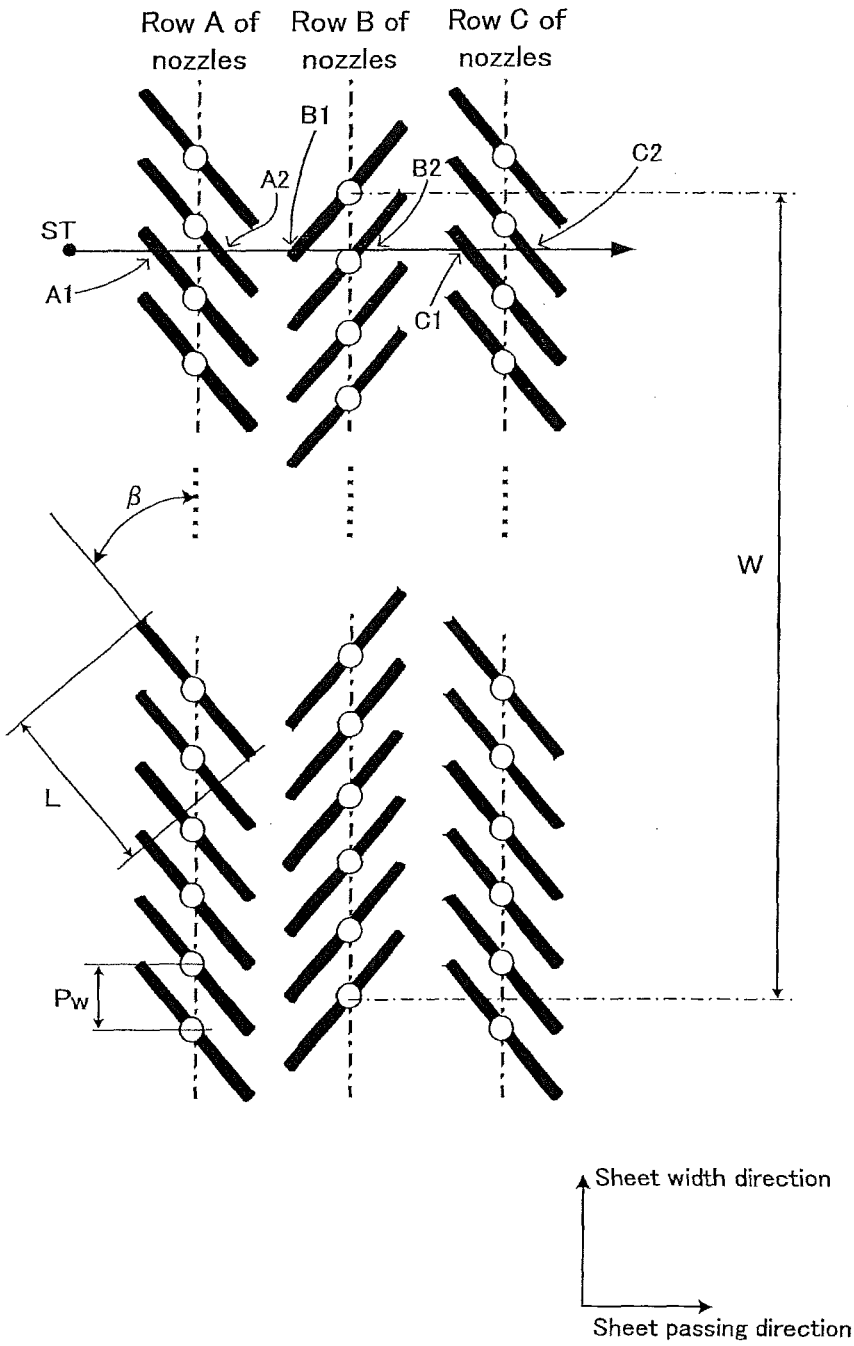
FIG. 5 is another view illustrating the cooling nozzle.

An end portion of each of the conduits 21*b*, 21*b*, . . . is provided with each of the cooling nozzles 21*c*, 21*c*, . . . . The cooling nozzles 21*c*, 21*c*, . . . according to the embodiment are flat spray nozzles capable of forming a fan-like jet of cooling water (for example, a thickness of approximately 5 mm to 30 mm). FIGS. 4 and 5 is a schematic view of a jet of cooling water which is formed on the surface of the steel sheet by the cooling nozzles 21*c*, 21*c*, . . . . FIG. 4 is a perspective view. FIG. 5 schematically shows a manner of an impact of the jets on the surface of the steel sheet. In FIG. 5, an open circle shows a position right below the cooling nozzles 21*c*, 21*c*, . . . ; and a thick line shows an impact position and shape of the jets of cooling water. FIGS. 4 and 5 show both the sheet passing direction and the width direction of the steel sheet.

As can be seen from FIGS. 4 and 5, in the embodiment, the rows of nozzles adjacent to each other are arranged in a manner that the position of one of the rows in the width direction of the sheet differs from the position of its adjacent row. Further, the rows of nozzles are arranged in a so-called zigzag manner so that the position of one of the rows is the same as the position of the row which is located further next.

In the embodiment, the cooling nozzles are arranged so that an entire position of the surface of the steel sheet in the width direction of the steel sheet can pass through jets of cooling water at least twice. That is, a point ST at which the passing steel sheet is located moves along a linear arrow in FIG. 5. At this time, in such a manner as twice in a row A of nozzles (A1, A2); twice in a row B of nozzles (B1, B2); and twice in a row C of nozzles (C1, C2), in each of the rows of nozzles, the jets of water from the cooling nozzles belonging to the row of nozzles strike twice. As such, the cooling nozzles are arranged in a manner that the following relation is satisfied among a distance Pw between the cooling nozzles; an impact width L of jets of cooling water; and a twisting angle β.

$$L=2Pw/\cos\beta$$

Herein, the number of times at which the steel sheet passes through jets of cooling water is set to be twice, to which the number of times is not limited; it may be three or more times. For the purpose of uniforming a cooling capability in the width direction of the steel sheet, in the rows of nozzles adjacent to each other in the sheet passing direction, the cooling nozzles in one of the rows are twisted in an opposite direction from the cooling nozzles in its adjacent row.

Further, the "width of the uniformly cooled region" related to cooling of the steel sheet is determined by an arrangement of the cooling nozzles. This refers to a size of a region in the width direction of the steel sheet, in which region the transported steel sheet can be uniformly cooled, based on the characteristics of a group of cooling nozzles arranged. Specifically, the width of the uniformly cooled region often corresponds to a width of a maximum size of the steel sheet which can be manufactured by the manufacturing apparatus of a steel sheet. More specifically, it is the size shown as W in FIG. 5, for example.

A position at which the upper surface water supplying device 21 is provided, in particular, a position at which the cooling nozzles 21*c*, 21*c*, . . . are disposed is not particularly limited; however, the upper surface water supplying device, or the cooling nozzles are disposed at least right after the final stand 11*g* in the row 11 of hot finish rolling mills. In detail, the cooling nozzles are disposed from inside the housing 11*gh* of the final stand 11*g*, as closely to the work roll 11*gw* in the final stand 11*g* as possible. This arrangement enables rapid cooling of the steel sheet 1 immediately after rolling by the row 11 of hot finish rolling mills. It is also possible to stably guide a top portion of the steel sheet 1 into the cooling apparatus 20. In the embodiment, as seen from FIG. 2, the cooling nozzle 21*c* which is close to the work roll 11*gw* is arranged closely to the steel sheet 1.

Further, a direction in which the cooling water is sprayed from a cooling water ejection outlet of each of the cooling nozzles 21*c*, 21*c*, . . . is basically a vertical direction; however, the ejection of the cooling water from the cooling nozzle which is closest to the work roll 11*gw* in the final stand 11*g* is preferably directed more toward the work roll 11*gw* than vertically. This configuration can further shorten the time period from reduction of the steel sheet 1 in the final stand 11*g* to initiation of cooling the steel sheet. And the recovery time of rolling strains accumulated by rolling can also be reduced to almost zero. Therefore, a finer-grained steel sheet can be manufactured.

The lower surface water supplying devices 22, 22, . . . are devices to supply cooling water to the lower surface side of the steel sheet 1. The lower surface water supplying devices 22, 22, . . . comprise: cooling header 22*a*, 22*a*, . . . ; conduits 22*b*, 22*b*, . . . , provided to each of the cooling headers 22*a*, 22*a*, . . . , in a form of a plurality of rows; and cooling nozzles 22*c*, 22*c*, . . . attached to an end portion of the conduits 22*b*, 22*b*, . . . . The lower surface water supplying devices 22, 22, . . . are arranged opposite to the above described upper surface water supplying devices 21, 21 . . . ; thus, a direction of a jet of cooling water by the lower surface water supplying device differs from that by the upper surface water supplying device. However, the lower surface water supplying device is generally the same in structure as the upper surface water supplying device; so the descriptions of the lower surface water supplying device will be omitted.

Figure 6A:
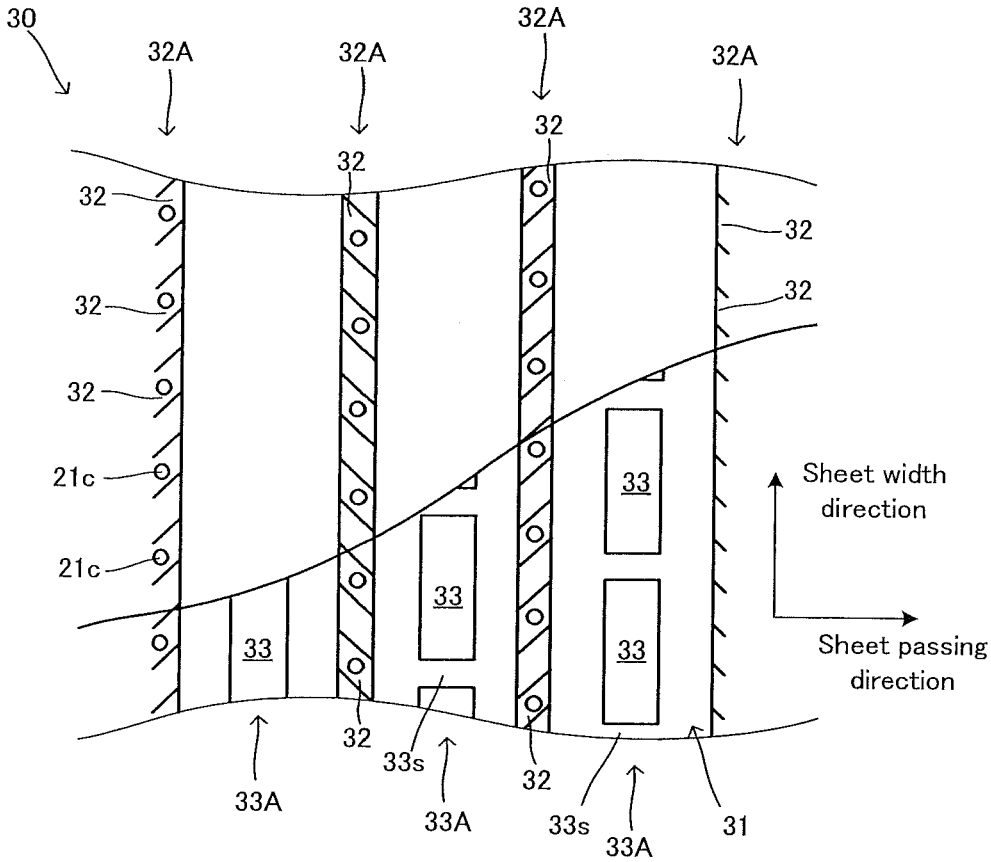
FIG. 6 is a view illustrating an upper surface guide.
Figure 6B:
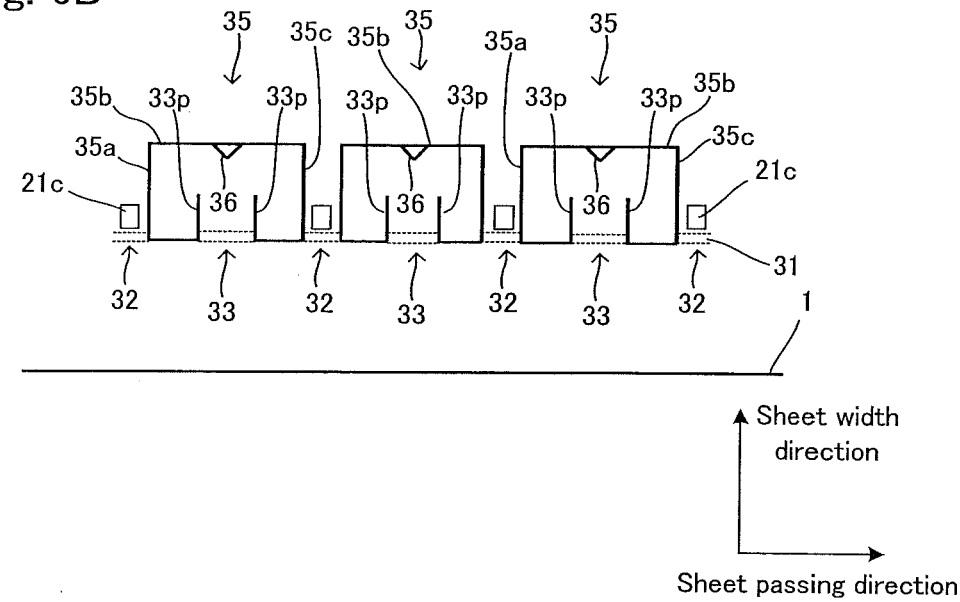

Next, an upper surface guide 30 will be described. The upper surface guide 30 is schematically shown in FIG. 6. FIG. 6A is a partially cutout view of the upper surface guide 30 seen from the top of the cooling apparatus 20. FIG. 6B is a view seen from the side surface of the cooling apparatus. FIG. 6 also shows a position of the cooling nozzles 21*c*, 21*c*, . . . and a position of the steel sheet 1.

The upper surface guide 30 comprises: a guide sheet 31, which is in a sheet shape; and portions 35, 35, . . . forming a water discharging passage, which are disposed on an upper surface side of the guide sheet 31.

The guide sheet 31 is a sheet-shaped member, and is provided with inlet holes 32, 32, . . . and outlet holes 33, 33, . . . .

The inlet holes 32, 32, . . . are arranged at a position corresponding to the above described cooling nozzles 21*c*, 21*c*, . . . and a shape of the inlet holes also corresponds to the shape of a jet of water. Thus, the inlet holes 32, 32, . . . are aligned in the width direction of the steel sheet to form a row 32A of inlet holes; and the rows 32A, 32A, . . . of inlet holes are also aligned in the sheet passing direction. Here, the shape of the inlet hole is not particularly limited as long as the inlet hole is shaped in a manner that jets of water from the cooling nozzles strike against the guide sheet as little as possible. Specifically, though it depends on the characteristics of a jet of water from the cooling nozzles 21*c*, 21*c*, . . . to be used, the inlet hole is preferably in a shape which allows cooling water to pass without having 10% or more of a total volume of the cooling water ejected from one nozzle 21*c* per time unit strike against the guide sheet 31 of the lower surface guide 30. Further, to efficiently provide the inlet holes 32, 32, . . . in a limited space, it is preferable that the shape of the opening of the inlet hole be substantially similar to a cross-sectional shape of a jet of cooing water (a cross section orthogonal to a direction of an ejection axis).

On the other hand, the outlet holes 33, 33, . . . are configured to be rectangular holes; and a plurality of the outlet holes are aligned in the width direction of the steel sheet to form a row 33A of outlet holes. By having a part of the guide sheet 31 remain between the outlet holes 33, 33, . . . , the top portion of the transported steel sheet is prevented from entering the outlet holes 33, 33, . . . . And this becomes a device 33*s*, 33*s*, . . . for preventing entering of a steel sheet. The rows 33A, 33A, . . . of outlet holes are disposed between the above described rows 32A, 32A, . . . of inlet holes.

That is, the row 32A of inlet holes and the row 33A of outlet holes are disposed alternately on the guide sheet 31 along the sheet passing direction.

Herein, as a preferable shape of the opening of the outlet holes 33, 33, . . . , the rectangular shape of the opening aligned as above has been described. This shape makes it possible to efficiently obtain a large area of an opening in a limited space; however, the shape is not limited to this as long as it can secure an adequate amount of discharged water and can prevent a steel sheet from getting stuck. Namely, the shape of the opening of the outlet hole is not limited to a rectangular shape described above; it may be a circular and trapezoidal shape.

And a shape of the device for preventing entering of a steel sheet corresponds to the shape of the opening. For example, when the outlet hole is in a trapezoidal shape having a top base and a bottom base in the sheet passing direction, the device for preventing entering of a steel sheet may be in a parallelogram shape leaning away from the sheet passing direction.

Figure 7:
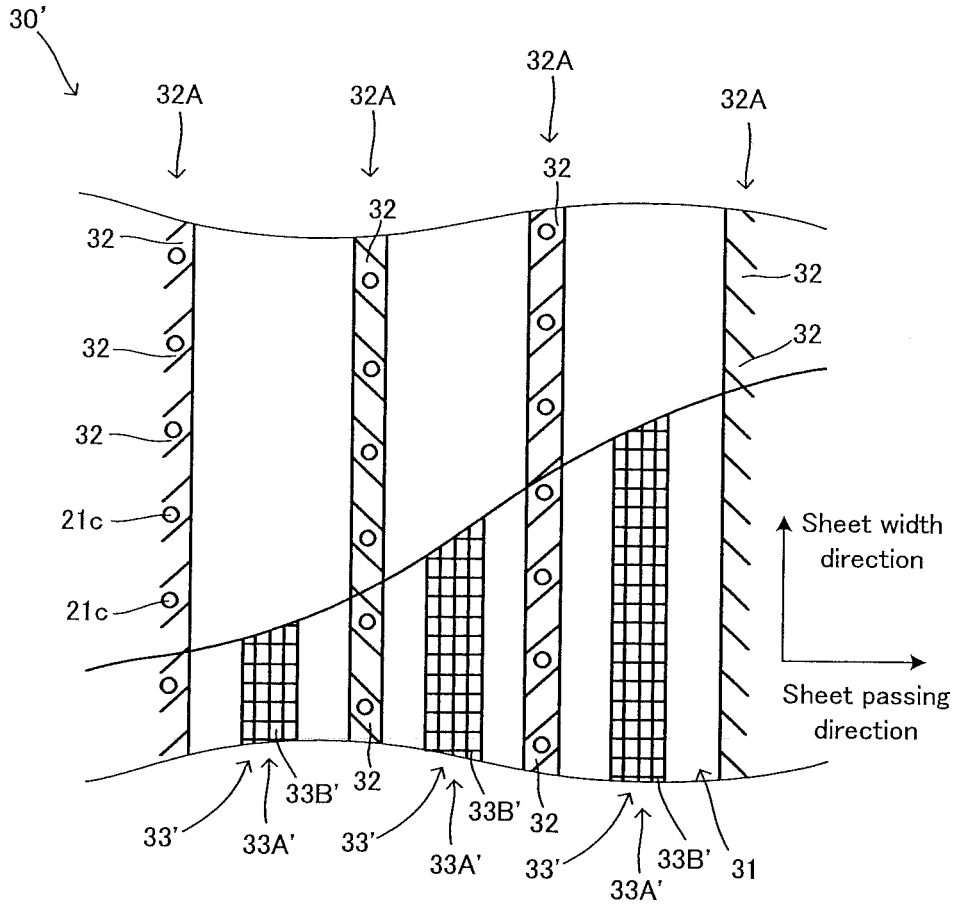
FIG. 7 is a view illustrating another mode of an outlet hole of the upper surface guide.

FIG. 7 shows a modification of the outlet hole. The upper surface guide 30' shown in FIG. 7 as a modification is the same as the upper surface guide 30 except that an outlet hole 33' of the upper surface guide 30' is different, so the same symbols are given to the same portions and the descriptions are omitted. The outlet hole 33' of the upper surface guide 30' is configured to be one long hole 33A' in the width direction of the steel sheet, on which a net material 33B' is spread. With this configuration as well, it is possible to form an outlet hole. To cause little influence on a flow of cooling water and to prevent such foreign substances as dirt from getting stuck, a so-called mesh size of the net material 33B' is preferably 5 mm×5 mm or more.

Back to FIG. 6, the descriptions of the upper surface guide 30 will be continued. Among the edges of the outlet holes 33, 33, . . . , the edges orthogonal to the sheet passing direction comprise backflow preventing members 33*p*, 33*p*, . . . arranged to stand in an upward direction from the edges. These backflow preventing members 33*p*, 33*p*, . . . are arranged so as to prevent the water having entered the outlet holes 33, 33, . . . from flowing back again to the original position from the outlet holes 33, 33, . . . . By arranging these backflow preventing members 33*p*, 33*p*, . . . , it is possible to secure a larger amount of discharged water, thus improving a water discharging ability.

In the embodiment, the backflow preventing members 33*p*, 33*p*, . . . are arranged to stand in approximately parallel with each other; however, the backflow preventing member may be arranged to stand in a manner that its upper end side is narrower than its lower end side. With this configuration, it is possible to secure a wide cross-sectional area of a flow path between the backflow preventing member and a standing member (35*a*, 35*c*) of a below described portion forming a water discharging passage.

As seen from FIG. 6B, portions 35, 35, . . . forming a water discharging passage are portions extending in the width direction of the steel sheet, comprising a recess-shaped cross section surrounded with the members 35*a*, 35*b*, 35*c*. The portion 35 forming a water discharging passage is arranged in a manner overlaying the upper surface of the guide sheet 31 with the recess-shaped opening facing the guide sheet 31. At this point, the recess-shaped opening overlays the guide sheet 31 in a manner including a part of the upper surface of the guide sheet 31 and the row 33A of outlet holes therein, in other words, between the member 35*a* and the member 35*c*. Further, the portions 35, 35, . . . forming a water discharging passage adjacent to each other have a predetermined spacing, in which the rows 32A, 32A, . . . of inlet holes and the cooling nozzles 21*c*, 21*c*, . . . are disposed. Furthermore, as for the member 35*b* opposite to the row 33A of outlet holes, the member 35*b* on a side of the row 33A of outlet holes has a rectifying device 36 arranged at the position right above the row 33A of outlet holes. The rectifying member 36 is preferably in a shape capable of rectifying discharge of water so as to separate the discharged water striking against the member 35*b* in a direction toward a bottom surface of the water discharging passage provided with the backflow preventing members 33*p*, 33*p*, as described below. Examples include an upside-down triangle, trapezoid, wedged shape, or other protruding shapes.

Here, a height of the portions 35, 35, . . . forming a water discharging passage is not particularly limited; however, when an inner diameter of the conduits 21*b*, 21*b*, of the upper surface water supplying device 21 is defined as d, the height is preferably within a range of 5 d to 20 d. This is because, if the conduits 21*b*, 21*b*, . . . are longer than 20 d, a loss of pressure is increased, which is not preferable. Further, if the conduits are shorter than 5 d, the ejection from the cooling nozzles is unlikely to be stabilized.

The upper surface guide 30, described so far is arranged as shown in FIG. 2. In the embodiment, three upper surface guides 30, 30, 30 are used and are aligned in the sheet passing direction. All of the upper surface guides 30, 30, 30 are arranged in a manner corresponding to a position at a height of the cooling nozzles 21*c*, 21*c*, . . . . In other words, in the embodiment, the upper surface guide 30 closest to the final stand 11*g* is arranged in an inclined manner to have its end portion on a side of the final stand 11*g* positioned lower and its end portion on the other side positioned higher. The other two upper surface guides 30, 30 are arranged in approximately parallel with a surface of the passing steel sheet, with a predetermined spacing from the surface of the passing steel sheet.

With this upper surface guide 30, it is possible, as a fundamental function of the upper surface guide 30, to solve a problem that a top portion of a steel sheet gets stuck in the cooling nozzles 21*c*, 21*c*, . . . or the like when passing.

Further, with the upper surface guide 30, it is possible to appropriately discharge a large volume of cooling water supplied to the upper surface side of the steel sheet. First, after the steel sheet is cooled by the cooling water supplied by the upper surface water supplying devices 21, 21, . . . , a part of the cooling water flows in the width direction of the steel sheet and drops downwardly to be discharged. It has been attempted to improve the discharging ability of this water discharge, dropping downwardly, by adopting the below described configuration.

On the other hand, by further providing a water discharging passage to the upper surface guide 30, it is possible to help water discharge and to keep the retained water thin. Details are described as follows.

Figure 8:
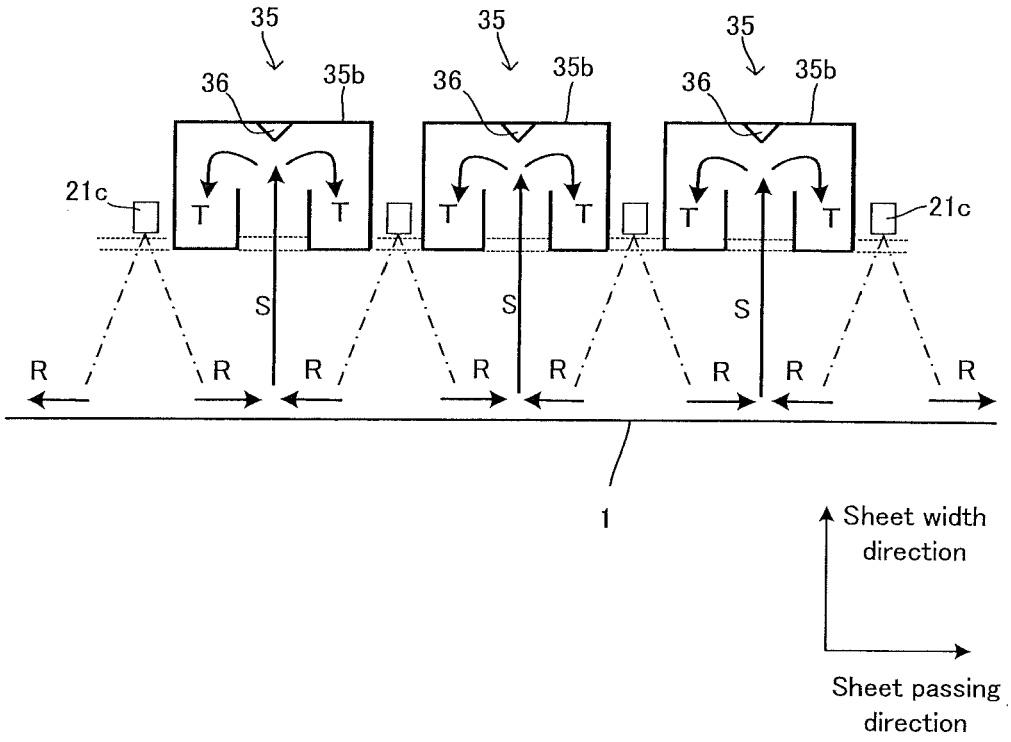
FIG. 8 is a view illustrating a flow of cooling water by the upper surface guide.

FIG. 8 is a view for the description. In FIG. 8, symbols are omitted for the purpose of easy understanding; as for the components corresponding to those in FIG. 6B, the symbols used therein may be referred to. In a case of a high flow density of cooling water, and a large volume of supplied cooling water, a force of the flow of water from the cooling nozzles 21*c*, 21*c*, . . . is also strong. In this case, the cooling water sprayed over the upper surface of the steel sheet 1 also moves back and forth in the sheet passing direction as shown in the arrows R, R in FIG. 8, and strikes against each other. The impact in this way causes the cooling water to change its direction; to move upward as shown by the arrow S; to pass through the outlet holes 33, 33, . . . ; and to strike against the member 35*b* of the portion 35 forming a water discharging passage. At this point, the rectifying member 36 arranged on the member 35*b* as described above allows the cooling water to change its direction as shown by the arrows T, T. Therefore, resistance of cooling water to this change in direction is suppressed to a small degree by the rectifying member 36; thereby ensuring efficient water discharge.

By this, the cooling water having reached the upper surface side of the guide sheet 31 moves in a direction toward a back part or toward a front part on the sheet of FIG. 8, to be discharged. At this point, the backflow preventing members

33*p*, 33*p*, which are arranged at the edges of the outlet hole 33, inhibit the cooling water from flowing back again from the outlet hole 33.

In this way, by further providing the water discharging device, even in a case of a large volume and a high flow density of cooling water supplied to the upper surface side, it is possible to suppress the amount of retained water. Moreover, by the above configuration together with separating a hole to which cooling water is supplied and a hole through which the cooling water is discharged, it is possible to inhibit the cooling water which is supplied for cooling and the cooling water which has started moving to be discharged from striking against each other along the way. This facilitates water supply and water discharge and lessens a thickness of the retained water, thereby enhancing a cooling efficiency.

By facilitating water discharge and suppressing the retained water in this way, it is also possible to reduce cooling nonuniformity in the width direction of the steel sheet. Then, a steel sheet having a more uniform quality can be obtained. As to the cooling nonuniformity, nonuniformity of a temperature of the cooling water in the width direction of the steel sheet is preferably within ±30° C.

In the embodiment, the outlet holes 33, 33, . . . included in one row 33A of outlet holes are arranged over the entire region of the upper surface guide 30 in the width direction of the sheet; however, an arrangement is not limited to this. For example, these outlet holes may be provided, for example, only around the middle portion of the steel sheet in the width direction of the sheet, where the retained water tends to be thick.

In discharging the cooling water having reached the upper surface of the guide sheet 31 from both ends of the guide sheet 31 in the width direction, a configuration to further improve the water discharging ability can be added. Examples include the following.

The upper surface side of the guide sheet 31 may be configured to have its middle portion in the width direction of the steel sheet formed to be higher, and may arrange a slope lowering toward both ends in the width direction of the steel sheet. With this configuration, because of the height differences, it becomes easier for the discharged water to move toward both ends of the guide sheet 31 in the width direction of the steel sheet, thereby further facilitating water discharge.

Further, a water discharging ability may be further improved by forcefully discharging water with a pump or the like, or by applying negative pressure inside the portion forming a water discharging passage and making it easy to guide the cooling water into the portion forming a water discharging passage.

Still further, a configuration may also be provided in which the upper surface guide is formed in a manner movable in an upward and downward direction by itself and is made to move downwardly to a degree not affecting passing of a steel sheet, thereby compressing the retained water to be forcefully guided into the portion forming a water discharging passage.

Furthermore, the edges of the outlet holes 33, 33, . . . provided to the guide sheet 31, or the edges of both ends of the guide sheet in the width direction of the steel sheet may be chamfered or rounded (i.e. formed in an arc-like shape). This configuration can prevent the passing steel sheet from getting stuck and can facilitate a smooth flow of cooling water.

A material of the guide sheet 31 may be a common material having strength or heat resistance which are required to function as a guide, and the material is not particularly limited. However, for the purpose of reducing scratches and the like on the steel sheet 1 caused at a time when the passing steel sheet contacts with the guide sheet 31, a material such as resin and the like which is softer than the steel sheet 1 may be used for a portion which does not cause a problem in strength and heat resistance.

Figure 9A:
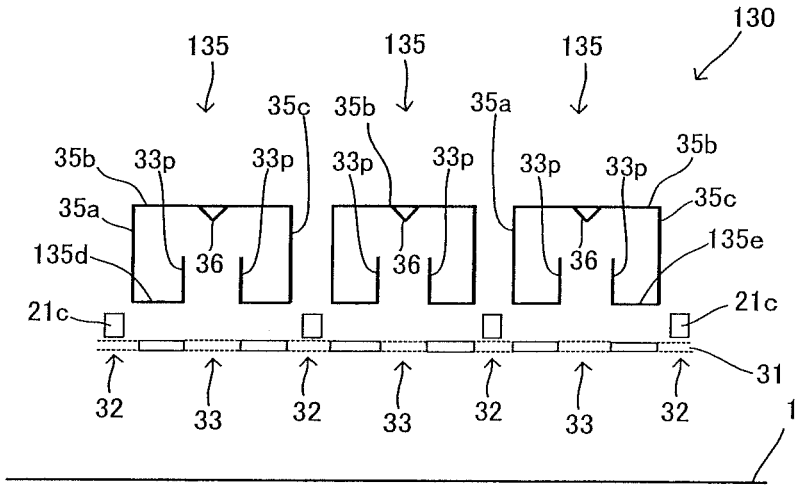
FIG. 9 is a view showing another mode of the upper surface guide.
Figure 9B:
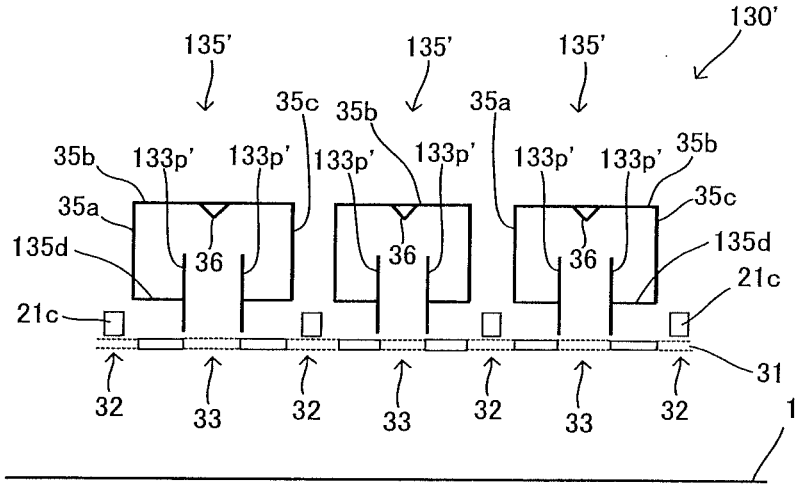

FIG. 9 shows a part of the upper surface guides 130, 130' in another embodiment, the part corresponding to that shown in FIG. 6B. FIG. 9A shows the upper surface guide 130, and FIG. 9B shows the upper surface guide 130'. Here, with regard to the members in common with those of the upper surface guide 30, the same symbols are given, and the descriptions are omitted.

In the upper surface guide 130, portions 135, 135, . . . forming a water discharging passage are configured to be separated from the guide sheet 31. Thus, in the portions 135, 135, . . . forming a water discharging passage, the members 35*a*, 35*a*, . . . and the backflow preventing members 33*p*, 33*p*, . . . are connected to each other by bottom sheets 135*d*, 135*d*, . . . ; and the members 35*c*, 35*c*, . . . and the backflow preventing members 33*p*, 33*p*, . . . are connected to each other by bottom sheets 135*e*, 135*e*, . . . . Further, the bottom sheets 135*d*, 135*d*, and the bottom sheets 135*e*, 135*e*, . . . form a bottom portion of the water discharging passage. The upper surface guide 130 may be configured to be this way.

The upper surface guide 130' is configured to have the backflow preventing members 133*p'*, 133*p'*, . . . extending further toward the upper surface side of the guide sheet 31.

Figure 10A:
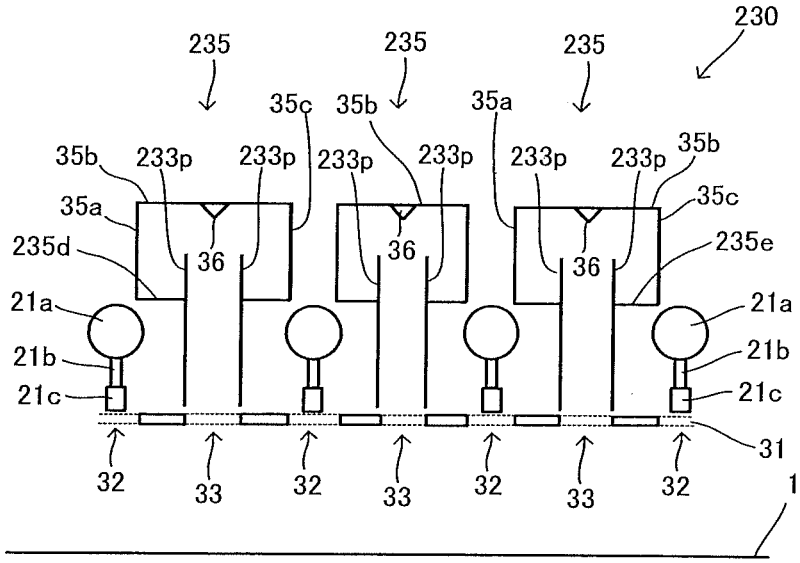
FIG. 10 is a view showing still another mode of the upper surface guide.
Figure 10B:
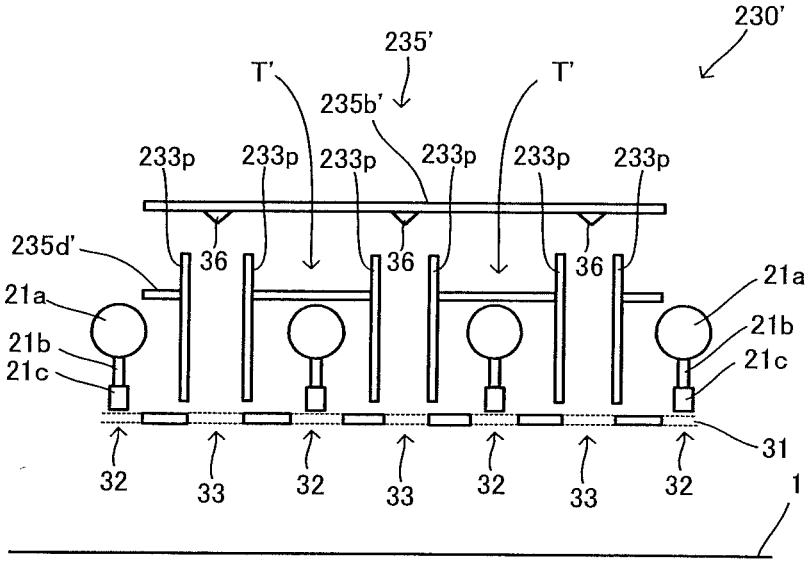

FIG. 10 shows a part of the upper surface guides 230, 230' in still another embodiment, the part corresponding to that shown in FIG. 6B. FIG. 10A shows the upper surface guide 230, and FIG. 10B shows the upper surface guide 230'. Herein, with regard to the members in common with those of the upper surface guides 30, 130, the same reference symbols are given, and the descriptions are omitted.

In the upper surface guide 230 as well, portions 235, 235, . . . forming a water discharging passage are formed in a manner being separated from the guide sheet 31. Thus, in the portions 235, 235, . . . forming a water discharging passage, the members 35*a*, 35*a*, . . . and the backflow preventing members 233*p*, 233*p*, . . . are connected to each other by bottom sheets 235*d*, 235*d*, . . . ; and the members 35*c*, 35*c*, . . . and the backflow preventing members 233*p*, 233*p*, . . . are connected to each other by bottom sheets 235*e*, 235*e*, . . . . And, the bottom sheets 235*d*, 235*d*, . . . and the bottom sheets 235*e*, 235*e*, . . . form a bottom portion of the water discharging passage. Further, the backflow preventing members 233*p*, 233*p*, . . . extend toward the upper surface side of the guide sheet 31. The upper surface guide 230, comprises not only the cooling nozzles 21*c*, 21*c*, . . . , but also the headers 21*a*, 21*a* . . . , and the conduits 21*b*, 21*b*, . . . between the guide sheet 31 and the portions 235, 235, . . . forming a water discharging passage. The upper surface guide 230 may be configured in this way.

The upper surface guide 230' comprises one portion 235' forming a water discharging passage by unifying the portions 235, 235, . . . forming a water discharging passage adjacent to each other in the upper surface guide 230. With this configuration as well, it is possible to secure a water discharging pathway shown as T', T' in FIG. 10B; thereby a large cross section of a flow path of the water discharging pathway (T') can be secured.

So far, one mode of an upper surface guide has been described; however an upper surface guide need not be limited thereto, and a conventional upper surface guide may be employed.

Next, the lower surface guide 40 will be described. The lower surface guide 40 is a sheet-shaped member, which is disposed between the lower surface water supplying device 22 and the pass line in which the steel sheet is transported. By this, it is possible to prevent a top portion of the steel sheet 1 from getting stuck in the lower surface water supplying devices 22, 22, . . . or the transporting rolls 12, 12, . . . , especially at a time of passing the steel sheet 1 into the manufacturing apparatus 10. On the other hand, the lower surface guide 40 is provided with an inlet hole through which a jet of water from the lower surface water supplying device 22 passes. With this configuration, it is possible for the jet of water from the lower surface water supplying device 22 to pass through the lower surface guide 40 to reach the lower surface of the steel sheet, thereby enabling appropriate cooling.

The lower surface guide 40, like this, is disposed as shown in FIG. 2. In the embodiment, four lower surface guides 40, 40, . . . are used and each of the lower surface guides are disposed between the transporting rolls 12, 12, . . . . All of the lower surface guides 40, 40, . . . are disposed at a position which is not too low in relation to the upper end portion of the transporting rolls 12, 12, . . . .

A shape of the lower surface guide 40 used herein is not particularly limited; a conventional lower surface guide may be employed. In cooling the lower surface, most of the discharged water after cooling the steel sheet drops downwardly to be discharged. Further, a case in which the lower surface guide is not provided (i.e. a case in which cooling between the transporting rolls is performed) is also applicable.

Figure 11:
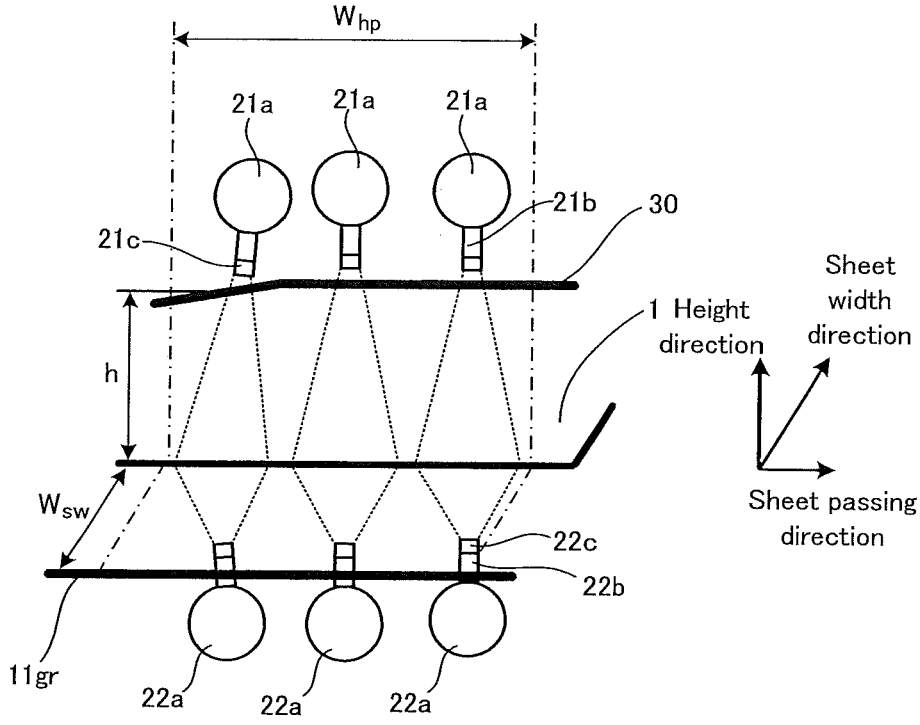
FIG. 11 a view illustrating derivation of a formula.

The cooling apparatus 20 has the following characteristics in relation to the housing 11*gh* of the above described final stand 11*g*. With this characteristics, it is possible to improve a volume of cooling water discharged from the width direction of the steel sheet, thereby enabling supply of a high flow density and a large volume of cooling water to be supplied. FIG. 11 shows a schematic view for illustrating the meaning of the symbols used in the following formulas. The part of the cooling apparatus 20, which is disposed inside the housing 11*g*, satisfies the formulas (1) and (2).

[Formula 1]

$$\left[1.7+\left(1-\frac{1}{C}\right)^2\right]+\frac{\left(Q_q\cdot\frac{W}{W_{SW}}\right)^2}{8g}<1 \quad (1)$$

[Formula 2]

$$Q_q > 0.08 \quad (2)$$

Here, W [m] refers to the width of the uniformly cooled region; and $W_{sw}$ [m] refers to the average gap distance between the end portion of the width of the uniformly cooled region and the standing side member of the housing, as shown in FIGS. 3 and 11. g [m/s$^2$] refers to the gravity acceleration rate; and $Q_q$ refers to the flow density determined by the below described formula (3). Further, C is a value determined by the below described formulas (4) and (5), and represents a coefficient of a loss of pressure caused by a shrinkage and an expansion of a cross-sectional area of discharged water created when the cooling water flows in the width direction of the steel sheet and flows out from the gap between the end portion of the width of the uniformly cooled region and the standing side member of the housing. Descriptions of $Q_q$ and C will be made later while representing $Q_q$ and C in the formulas (3) and (5).

The above formula (1) can be derived from the following idea. The cooing water supplied from the upper surface side is discharged separately in the width direction of the steel sheet after striking against the steel sheet. However, when the gap between the end portion of the width of the uniformly cooled region and the standing side member of the housing becomes narrower, the flow resistance increases at a time when the discharged water moves in the width direction of the steel sheet, strikes against the standing side members of the housing, and changes it direction to flow downwardly. Due to this increase in the flow resistance, the discharged water having struck against the standing side members of the housing bounces back to the side of the steel sheet; flows back from the jet hole of the upper surface guide to the side of the end portion of the cooling nozzles; and is retained also on the upper surface guide, causing the end portion of the cooling nozzle to sink in the retained water.

Specifically, a left side of the formula (1) shows the loss of pressure in a case when the cooling water is discharged between the end portion of the steel sheet in the width direction and the standing side member of the housing. If the loss of pressure is less than 1, as shown in the formula (1), the flow resistance at a time of water discharge, caused by the loss of pressure can be suppressed to a small degree, thereby enabling appropriate discharge of the cooling water. On the other hand, if the left side of the formula (1) becomes more than 1, the flow resistance becomes large enough to cause a phenomenon that the discharged water flows back from the jet hole of the upper surface guide, and the end portion of the cooling nozzle sinks in the water. Here, the value 1.7 in the formula (1) is a coefficient of the loss of pressure caused when the water discharged in the width direction of the steel sheet makes a turn (change of a water discharging direction) at a position between the end portion of the steel sheet in the width direction and the standing side member of the housing; and the value was obtained by an experiment.

Further, the reason why a range of the water volume density $Q_q$ is limited is as follows. In a case when the water volume density $Q_q$ is larger than 0.08 [m$^3$/(m$^2$·s)], a phenomenon sometimes occurs that the discharged water having struck against the standing side members bounces back to the side of the steel sheet; thus in order for appropriate water discharge, it is necessary to satisfy the formula (1). On the other hand, when the water volume density is less than 0.08 [m$^3$/(m$^2$·s)], a phenomenon is unlikely to occur that the discharged water having struck against the standing side members of the housing bounces back to the side of the steel sheet, therefore having no relevance to the formula (1).

$Q_q$ as in the formulas (1) and (2) will be explained. $Q_q$ [m$^3$/(m$^2$·s)] is an average water volume density in the width of the uniformly cooled region, and is presented by the following formula (3).

[Formula 3]

$$Q_q = \frac{Q}{W_{hp}\cdot W} \quad (3)$$

In the formula (3), Q [m$^3$/s)] refers to a flow; and $W_{hp}$ [m], as shown in FIG. 11, refers to a cooling distance in the transporting direction (sheet passing direction), in which distance the cooling nozzles 21, 21, . . . , are disposed within the standing side members 11*gr*. The formula (3) determines the water volume density on the uniformly cooled surface, by dividing the flow of the cooling water by the uniformly coolable area.

C as in the above formula (1) will be explained next. C is determined by the formulas (4) and (5).

[Formula 4]

$$C = 0.6 + \frac{0.04}{1 - \left(\frac{W_{SW}}{h}\right)^{0.5}} \left(\text{In a case of } \frac{W_{SW}}{h} < 1\right) \quad (4)$$

[Formula 5]

$$C = \frac{W_{SW}}{h} \left(\text{In a case of } \frac{W_{SW}}{h} \geqq 1\right) \quad (5)$$

Here, h [m] represents the average distance between the upper surface guide 30 and the steel sheet 1 as shown in FIG. 11. As can be seen from the formulas (4) and (5), C represents a coefficient of a loss of pressure in a case when a cross-sectional area of discharged water is shrunk (Formula (4), or expanded (including being equal. Formula (5)), the cross-sectional area of discharged water being created when the cooling water flows in the width direction of the steel sheet and flows out of the gap shown by $W_{sw}$. And the coefficient C was obtained by an experiment on a basis of a conventionally known experimental formula.

In accordance with this relationship between the cooling apparatus 20 in the manufacturing apparatus 10 and the housing 11*gh*, the cooling water supplied to the upper surface side of the steel sheet is appropriately discharged from between both sides of the steel sheet in the width direction and the housing 11*gh*, thereby facilitating effective cooling.

As described above, by regulating $W_{sw}$ as the gap distance between the end portion of the width of the uniformly cooled region and the standing side member of the housing so as to meet the formula (1), and by suppressing the flow resistance (of the discharged water), it becomes possible to secure a water discharging pathway formed in consideration of a volume of water to be supplied and a manner of the water jet. It also becomes possible to appropriately discharge the cooling water supplied to the upper surface side of the steel sheet from between the end portions of the width of the uniformly cooled region and the standing side members of the housing in a direction of the arrows D, D, shown in FIG. 3

The above relationship enables appropriate water discharge to be secured. Thus, in a case, for example, that the width of the steel sheet needed is determined, an arrangement of the standing side members of the housing in the final stand can be determined, and it can be one element of designing the manufacturing apparatus of a hot-rolled steel sheet. On the other hand, when arrangements of each portion in the final stand are determined, it is possible to determine the width of the steel sheet which can be manufactured while securing the appropriate water discharge.

Back to FIG. 2, the descriptions of the manufacturing apparatus 10 of a hot-rolled steel sheet will be continued. The transportation rolls 12, 12, . . . are tables for the steel sheet 1 and are also rolls which transport the steel sheet 1 in the sheet passing direction. As described above, the lower surface guides 40, 40, . . . are arranged between the transporting rolls 12, 12, . . . .

The pinch roll 13 also functions to remove water, and is arranged on the lower process side of the cooling apparatus 20. This pinch roll can prevent the cooling water sprayed in the cooling apparatus 20 from flowing out to the lower process side of the steel sheet 1. Furthermore, the pinch roll prevents the steel sheet 1 from ruffling in the cooling apparatus 20, and improves a passing ability of the steel sheet 1, especially at a time before the top portion of the steel sheet 1 enters the coiler. Here, an upper side roll 13*a* of the pinch roll 13 is movable upside down, as shown in FIG. 2.

A steel sheet is manufactured by the above described manufacturing apparatus of a hot-rolled steel sheet, for example, in the following way. A steel sheet is coiled by a coiler, and the ejection of cooling water in the cooling apparatus 20 is stopped during a non-rolling time until rolling of the next steel sheet is started. During the non-rolling time, the upper side roll 13*a* of the pinch roll 13 on the lower process side of the cooling apparatus 20 is moved up to a position higher than the upper surface guide 30 of the cooling apparatus 20; then rolling of the next steel sheet 1 is started.

When a top portion of the next steel sheet reaches the pinch roll 13, cooling by ejection of cooling water is started. And, immediately after the top portion of the steel sheet 1 passes through the pinch roll 13, the upper side roll 13*a* is lowered to start pinching the steel sheet 1.

Further, a sheet passing rate in the row of hot finish rolling mills may be kept constant except for the area in which the steel sheet starts to pass. This enables manufacturing of a steel sheet with an enhanced mechanical strength over the entire length of the steel sheet.

In discharge of the cooling water as above, a specific water discharging performance is adequately determined based on an amount of heat required to cool a steel sheet; thus the performance is not particularly limited. However, as described above, in view of making a steel sheet with a fine-grained structure, rapid cooling immediately after rolling is effective, which is why cooling water in a high flow density is preferably supplied. Therefore, it is preferable to ensure a water discharging performance corresponding to the volume and the flow density of the supplied cooling water. In view of obtaining a fine-grained steel sheet, an example of a flow density of supplied cooling water is 10–25 $m^3/[(m^2 \cdot min)]$. The flow density may be higher than this.

Examples

The present invention will be described below in more detail, on a basis of examples, to which the present invention is not limited.

Figure 12:
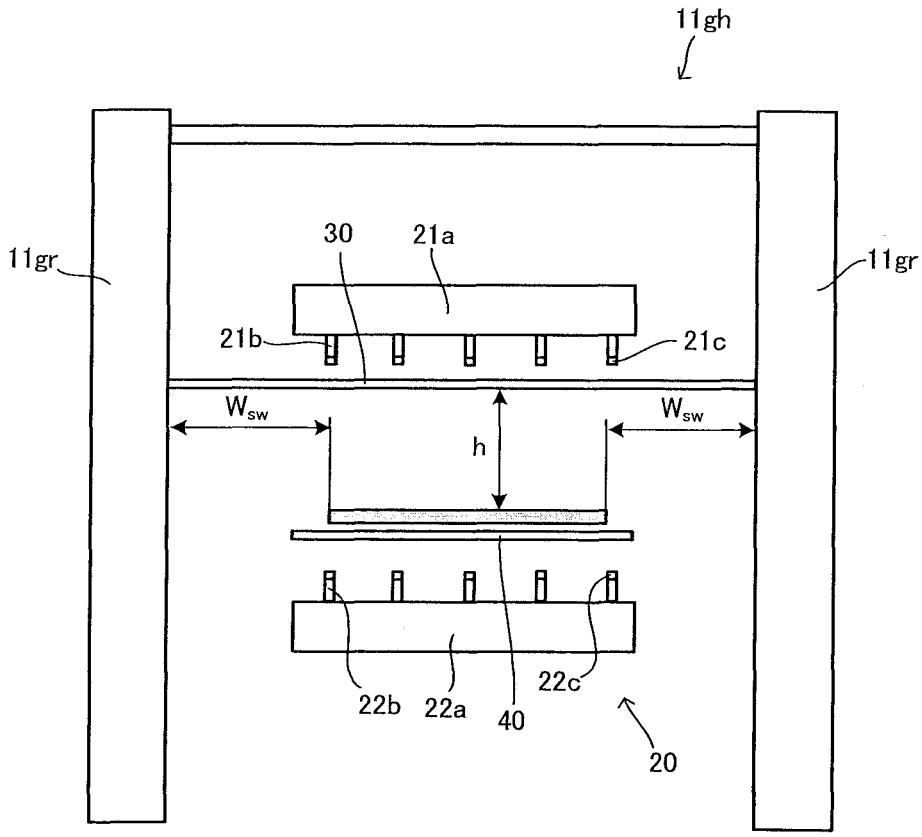
FIG. 12 is a view illustrating an example.

In the example, the retained water on the steel sheet was observed in a case when $Q_q$ was set at 0.33 $[m^3/(m^2 \cdot s)]$, h was set at 0.35 [m], and the gap distance $W_{sw}$ between the end portion of the width of the uniformly cooled region and the standing side member of the housing, as shown in FIG. 12, was changed. The results are shown in Table 1. Here, a case in which it was possible to discharge water without causing an end portion of a cooling nozzle to sink in the water was evaluated as good, whereas a case in which the end portion of the cooling nozzle sank in the retained water was evaluated as poor. In addition, the left side of the formula (1) was calculated in each of the cases, the results of which are also shown in the table.

TABLE 1

| $W_{sw}$ | Evaluation | Results of the calculation of the left side of the formula (1) |
|---|---|---|
| 0.44 | Good | 0.032 |
| 0.32 | Good | 0.063 |
| 0.20 | Good | 0.16 |
| 0.08 | Poor | 1.07 |

As can be seen from Table 1, in the cases when the gap distance $W_{sw}$ was 0.44 [m], 0.32 [m], and 0.20 [m], the cooling water supplied from the header was smoothly discharged from both ends of the steel sheet in a downward direction. It was confirmed that, in the above cases, the left side of the formula (1) became a value less than 1 and that the formula (1) was satisfied. On the other hand, in a case when the gap distance $W_{sw}$ was 0.08 [m], the discharged water having struck against the standing side members 11*gr* of the housing bounced back to the side of the steel sheet; and flew back through the jet hole of the upper surface guide 30 to the end portion of the cooling nozzle, causing the end portion of the cooling nozzle to sink in the retained water on the upper surface guide. In this case, it was confirmed that the left side of the formula (1) became 1.07, which was larger than 1, and that the formula (1) was not satisfied. From above, judgments on appropriateness of discharge of cooling water can be made by the formula (1).

The invention has been described above as to the embodiment which is supposed to be practical as well as preferable at present. However, it should be understood that the invention is not limited to the embodiment disclosed in the specification and can be appropriately modified within the range that does not depart from the gist or spirit of the invention, which can be read from the appended claims and the overall specification, and a manufacturing apparatus of a hot-rolled steel sheet and a manufacturing method of a steel sheet with such modifications are also encompassed within the technical range of the invention.

The invention claimed is:

1. A manufacturing apparatus of a hot-rolled steel sheet comprising:

a row of hot finish rolling mills; and a cooling apparatus which is disposed on a lower process side of a final stand in the row of hot finish rolling mills in a manner capable of cooling a steel sheet being transported on transporting rolls, wherein the final stand comprises a housing which holds a work roll;

the housing comprises a pair of standing side members;

the cooling apparatus comprises a plurality of rows of upper surface cooling nozzles which are provided with cooling nozzles capable of spraying cooling water over an upper surface of the transported steel sheet, and which are disposed along a transporting direction of the transported steel sheet;

the cooling apparatus comprises a plurality of rows of lower surface cooling nozzles which are provided with cooling nozzles capable of spraying cooling water over a lower surface of the transported steel sheet, and which are disposed along the transporting direction of the transported steel sheet;

the cooling apparatus comprises an upper surface guide which is disposed on the upper surface side of the transported steel sheet;

an end portion of the cooling apparatus on a side which is the closest to the final stand is disposed between the pair of the standing side members of the housing in the final stand; and when defining a width of a uniformly cooled region as W [m]; defining an average gap distance between the end portion of the width of the uniformly cooled region and the standing side member of the housing as $W_{sw}$ [m]; defining a gravity acceleration rate as g [m/s$^2$]; defining an average water volume density of the width of the uniformly cooled region as $Q_q$ [m$^3$/(m$^2$·s)]; defining a value determined by the average gap distance $W_{sw}$ and an average distance h [m] between the upper surface guide and the upper surface of the steel sheet as C; and satisfying a relation, $Q_q$>0.08, a relation $$\left[1.7+\left(1-\frac{1}{C}\right)^2\right]\cdot\frac{\left(Q_q\cdot\frac{W}{W_{SW}}\right)^2}{8g}<1$$

is satisfied.

2. The manufacturing apparatus of a hot-rolled steel sheet according to claim 1, wherein the cooling nozzle provided to the row of cooling nozzles is a flat spray nozzle.

3. A manufacturing method of a hot-rolled steel sheet, comprising the steps of:

rolling a steel sheet in a row of hot finish rolling mills; and cooling the steel sheet with water after the steel sheet has been rolled in the step of rolling;

wherein in the step of cooling with water, supplying water from both upper surface and lower surface sides of the steel sheet to cool the steel sheet, such that an average water volume density $Q_q$ [m$^3$/(m$^2$·s)] in a width of a uniformly cooled region is larger than 0.08 [m$^3$/(m$^2$·s)]; and discharging the water used for cooling from a gap between an end portion of the width of the uniformly cooled region and a standing side member of a housing in a final stand of the row of hot finish rolling mills, the gap satisfying a relation $$\left[1.7+\left(1-\frac{1}{C}\right)^2\right]\cdot\frac{\left(Q_q\cdot\frac{W}{W_{SW}}\right)^2}{8g}<1$$

when defining a width of a uniformly cooled region as W [m]; defining an average distance of the gap as $W_{sw}$ [m]; defining a gravity acceleration rate as g [m/s$^2$]; defining, as C, a value determined by the average gap distance $W_{sw}$ and an average distance h [m] between the upper surface guide used in the step of cooling with water and the upper surface of the steel sheet.

4. A manufacturing method of a hot-rolled steel sheet, according to claim 3; further comprising rolling the steel sheet with the largest rolling reduction of the final stand of the row of hot finish rolling mills.

5. A manufacturing method of a hot-rolled steel sheet, according to claim 3; further comprising starting cooling the steel sheet after pinching a top portion of the steel sheet by a pinch roll to apply tension to the steel sheet.

* * * * *